US010511087B1

(12) United States Patent
Rivera

(10) Patent No.: US 10,511,087 B1
(45) Date of Patent: Dec. 17, 2019

(54) PARALLEL PLATE ANTENNA

(71) Applicant: The United States of America as represented by the Secretary of the Navy, Newport, RI (US)

(72) Inventor: David F Rivera, Westerly, RI (US)

(73) Assignee: The United States of America as represented by the Secretary of the Navy

( * ) Notice: Subject to any disclaimer, the term of this patent is extended or adjusted under 35 U.S.C. 154(b) by 0 days.

(21) Appl. No.: 16/143,593

(22) Filed: Sep. 27, 2018

(51) Int. Cl.
*H01Q 1/42* (2006.01)
*H01Q 9/04* (2006.01)
*H01Q 1/12* (2006.01)

(52) U.S. Cl.
CPC ..... *H01Q 1/42* (2013.01); *H01Q 1/12* (2013.01); *H01Q 9/0407* (2013.01)

(58) Field of Classification Search
CPC ..... H01Q 1/42; H01Q 1/12; H01Q 9/0407
See application file for complete search history.

(56) References Cited

U.S. PATENT DOCUMENTS 6,677,915 B1 * 1/2004 Yablonovitch ..... H01O 13/12 343/744
8,228,243 B1 * 7/2012 Rivera ..... H01Q 9/0414 343/702
2004/0183731 A1 * 9/2004 Darden ..... H01Q 1/12 343/702

* cited by examiner

*Primary Examiner* — Dieu Hien T Duong
(74) *Attorney, Agent, or Firm* — James M. Kasischke; Michael P. Stanley

(57) ABSTRACT

An antenna includes a base, and first and second supports coupled to the base and extending perpendicular therefrom. The first and second supports oppose one another and are spaced apart from one another. The antenna also includes a plurality of plates spaced apart and parallel to one another. Each plate is T-shaped to have a trunk and a top wherein a width of the trunk is less than a width of the top. Each trunk is coupled to one of the first support and second support, and extends perpendicular thereto wherein a corresponding top of the plate is spaced from an opposing one of the first support and second support to thereby generate a gap region that serpentines between the first support and second support and around the top of each of the plates.

25 Claims, 3 Drawing Sheets

PARALLEL PLATE ANTENNA

STATEMENT OF GOVERNMENT INTEREST

The invention described herein may be manufactured and used by or for the Government of the United States of America for governmental purposes without the payment of any royalties thereon or therefor.

CROSS REFERENCE TO OTHER PATENT APPLICATIONS

None.

BACKGROUND OF THE INVENTION

(1) Field of the Invention

The present invention relates generally to antennas, and more particularly to a parallel plate antenna.

(2) Description of the Prior Art

U.S. Pat. No. 8,228,243 disclosed a parallel plate antenna designed for use in a field-deployed shielded room. Specifically, the antenna was designed to determine a radio-frequency (RF) "leakiness" of the shielded room. Such leakiness generally occurs at holes, ports, windows, etc., that exist in the walls or roof of the room. The antenna of the cited reference is placed in a room that is to be evaluated and measures RF energy associated with test pulses directed towards the room from a location outside thereof. The parallel plate antenna is compact and effective, but can only operate over a limited bandwidth; thereby, limiting the value of the antenna beyond very specific applications.

SUMMARY OF THE INVENTION

Accordingly, it is an object of the present invention to provide a compact antenna having a broad operational bandwidth.

It is a further object of the present invention to provide a compact antenna that can be adapted to any center frequency of operation.

To attain the objects of the present invention, an antenna is provided which includes a base, a first support coupled to the base and extending perpendicular therefrom, and a second support coupled to the base and extending perpendicular therefrom. The first support and second support oppose one another and are spaced apart from one another.

The antenna also includes a plurality of plates spaced apart and parallel to one another. Each plate is "T-shaped" to have a trunk and a top wherein a width of the trunk is less than a width of the top. Each trunk is coupled to one of the first support and second support, and extends perpendicular thereto wherein a corresponding top of the plate is spaced from an opposing one of the first support and second support by a distance to thereby generate a gap region that serpentines between the first support and second support and around the top of each of the plates. Each of the base, first support, second support, and plates is electrically conductive.

BRIEF DESCRIPTION OF THE DRAWINGS

Other objects, features and advantages of the present invention will become apparent upon reference to the following description of the preferred embodiments and to the drawings, wherein corresponding reference characters indicate corresponding parts throughout the several views of the drawings and wherein.

DETAILED DESCRIPTION OF THE INVENTION

Figure 1:
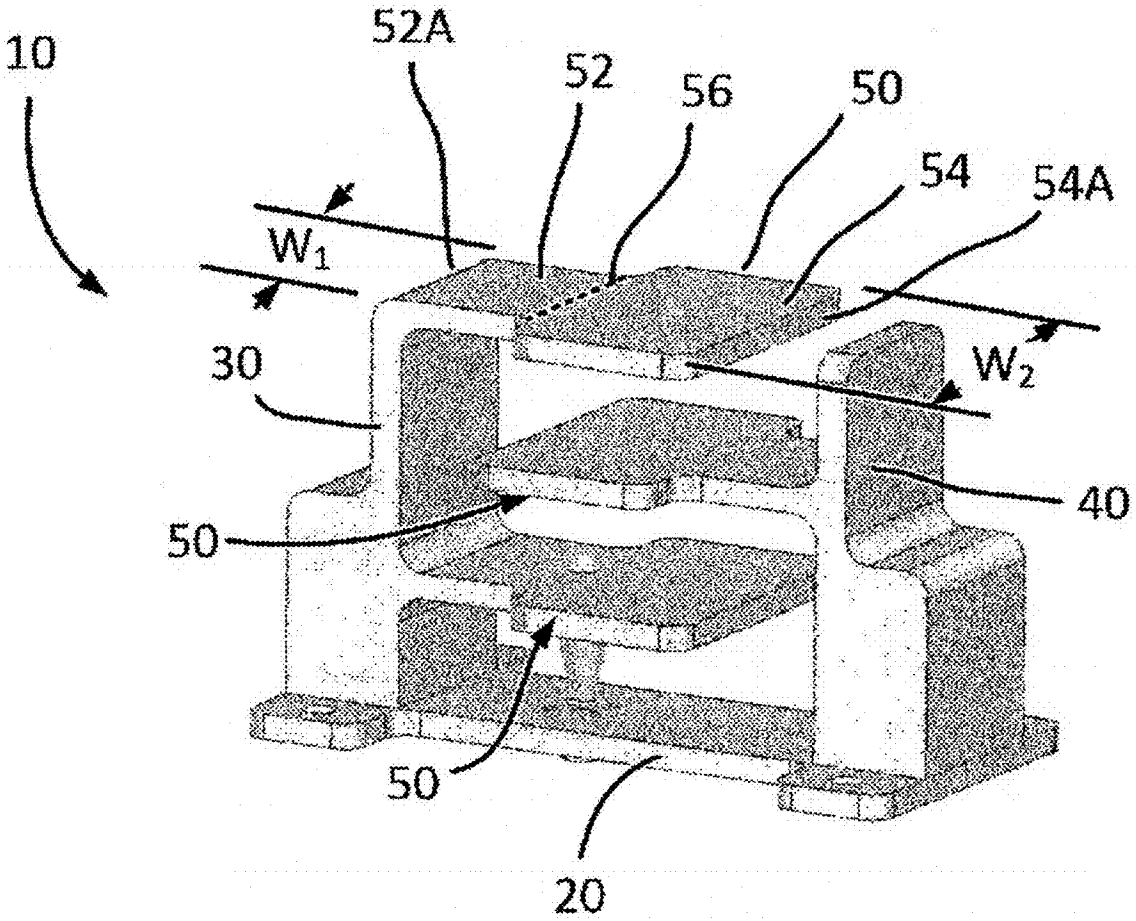
FIG. 1 is a perspective view of a parallel plate antenna in accordance with an embodiment of the present invention.
Figure 2:
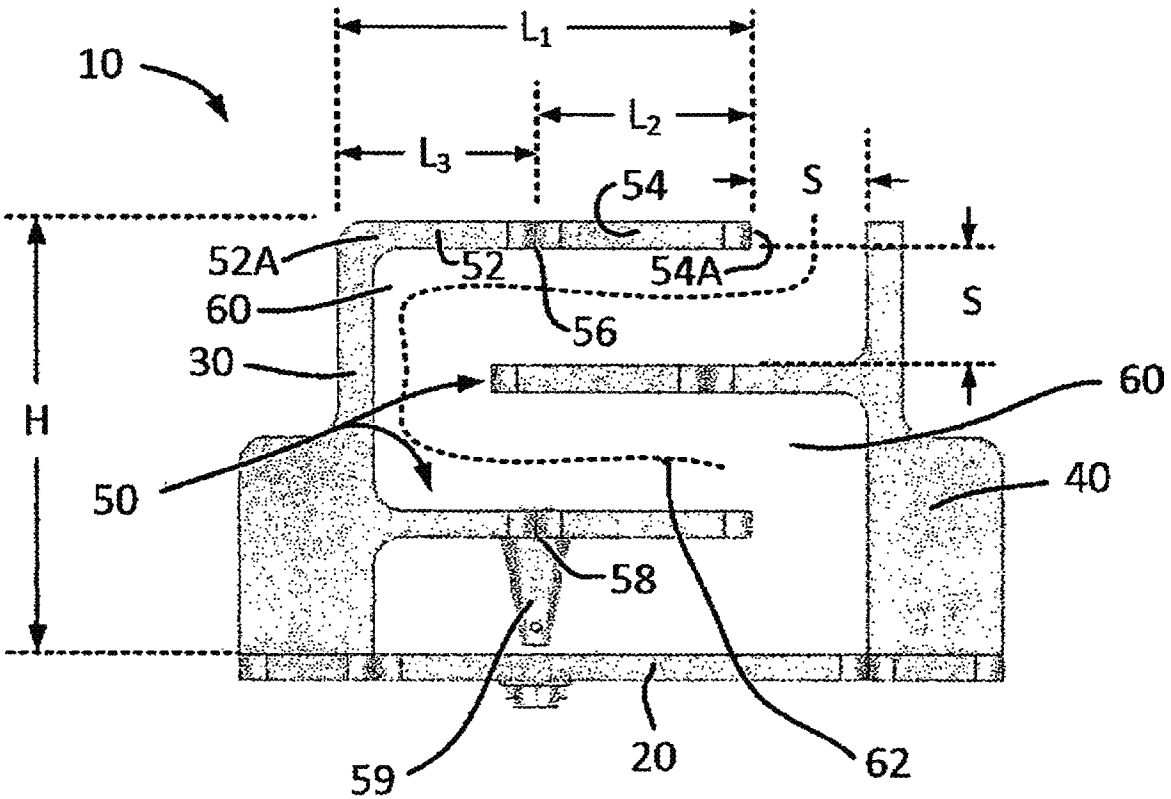
FIG. 2 is a side view of the parallel plate antenna of the present invention.

Referring now to the drawings, simultaneous reference will be made to FIG. 1 and FIG. 2 where a parallel plate antenna in accordance with an embodiment of the present invention is shown and is referenced by numeral 10. In the illustrated embodiment, three parallel plates are shown. However, it is to be understood that an antenna in accordance with the present invention could be constructed with additional parallel plates without departing from the scope of the present invention.

In general, various parts of antenna 10 need to be electrically conductive. Such electrical conductivity can be achieved by using solid metals for the various parts and metal-coated non-conductive substrates for the various parts without departing from the scope of the present invention.

The antenna 10 includes a base 20, a first support 30 and a spaced-apart second support 40 coupled to the base and extending perpendicularly away therefrom with a series of parallel plates 50 with each plate coupled to one of the supports 30 and 40 and extending perpendicularly away therefrom in a cantilevered fashion. The term "coupled" used herein refers to a mechanical and electrical coupling. The antenna 10 can be cast as a single structural element or assembled from individual elements without departing from the scope of the present invention.

The base 20 provides mechanical support for each of the supports 30 and 40. The base 20 also serves as an attachment point to an electrical ground plane (not shown) for the antenna 10. Each of the supports 30 and 40 has one or more of the plates 50 coupled thereto. Each of the plates 50 is identically sized and shaped such that a description of only one plate will be provided herein.

Each plate 50 is a T-shaped plate having a trunk 52 adjoining a top 54 at an interface designated by a dashed line 56. The width $W_1$ of the trunk 52 is less than the width $W_2$ of the top 54. An interface 56 on the plate 50 that is nearest to the base 20 serves as an antenna feed point referenced by numeral 58. The location of the antenna feed point 58 is selected to provide a 50 ohm match. The configuration of an antenna feed 59 coupled to the feed point 58 can be conical (as shown), cylindrical, a plate, etc., without departing from the scope of the present invention.

An outboard end 52A of the trunk 52 is coupled to one of the supports 30 or 40; while an outboard end 54A of the top 54 is spaced apart from the opposing supports by a distance S. The plates 50 are arranged in an alternating fashion with respect to their respective support so that the combination of the supports 30 and 40 with the plates coupled thereto define a continuous gap region 60 that traverses a serpentine path indicated by dashed line 62 in FIG. 2. The serpentine path falls between the supports 30 and 40 and around each outbound end 54A of the tops 54.

Additional dimensions for each plate 50 include the overall length $L_1$ of the plate where length $L_1$ is measured perpendicular to width $W_2$ of the top 54. The length $L_2$ of the top 54 is also measured perpendicular to width $W_2$ of the top. The length $L_3$ of the trunk 52 is measured perpendicular to width $W_1$ of the trunk.

Additional dimensions for the antenna 10 include the spacing between adjacent ones of the plates 50 which, in the illustrated embodiment, is equal to the distance S between the outboard end 54A and the support it is spaced apart from. The overall height H of the antenna 10 is measured from the base 20 to the plate 50 furthest from the base 20. Furthermore, in the illustrated embodiment, the width of each support 30 and 40 is equal to width $W_1$ of the trunk 52.

In general, the bandwidth of the antenna comes from the ratio of the width of the plate 50 to the spacing between the plates. With the plates 50 arranged to define the above-described serpentine path, the plates act as a transmission line where the plate width-to-plate spacing ratio determines, in effect, the characteristic impedance of the transmission line. However, the wider top sections at the ends of the plates 50 provide additional capacitance so that the resulting transmission line could be thought of as a cascade of transmission lines with varying characteristic impedance.

In other words, starting at the opening between the topmost plate 50 and the support 40, the plate is wider because of the "T" shape such that the characteristic impedance is smaller there as compared to the characteristic impedance at the smaller plate width. As a result, the antenna 10 presents a transmission line whose characteristic impedance alternates all the way down to the feed region of the antenna.

The antenna 10 as described above can be sized and configured for an operating wavelength λ in accordance with the following dimensional constraints:

$$L_1 \approx W_2 = \frac{\lambda}{14} \tag{1}$$

$$L_2 \approx W_1 = \frac{\lambda}{25}$$

$$S = \frac{\lambda}{42}$$

$$H = \frac{\lambda}{12}$$

$$L_3 = \frac{\lambda}{36}$$

By adhering to the above dimensional constraints, the antenna 10 yields improved bandwidth performance as compared to a similarly dimensioned parallel plate antenna constructed in accordance with U.S. Pat. No. 8,228,243.

Figure 3:
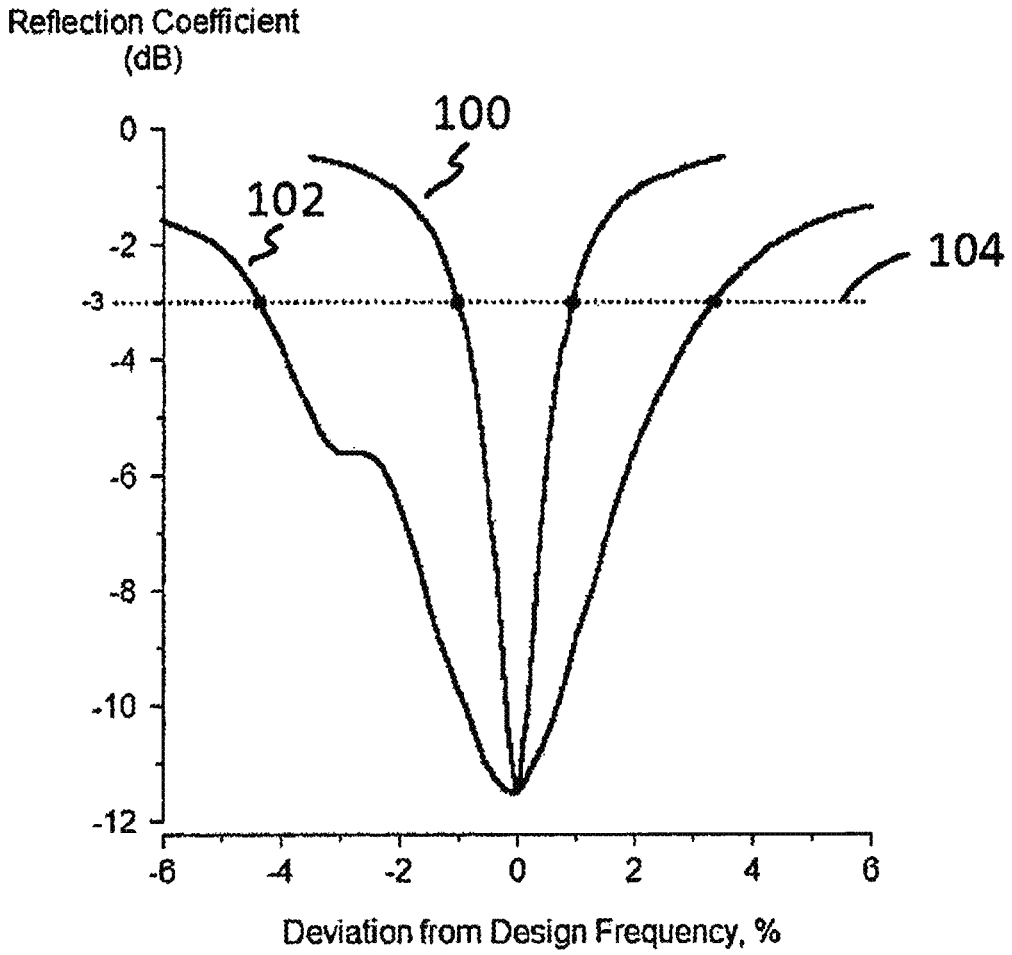
FIG. 3 is a plot of reflection coefficient versus the deviation from the design frequency for a prior art parallel plate antenna and an embodiment of a parallel plate antenna in accordance with the present invention.

For example, FIG. 3 illustrates a bandwidth curve 100 associated with a parallel plate antenna constructed in accordance with the above-referenced patent to have a plate width-to-plate spacing ratio of 7.5. Bandwidth curve 102 is associated with the above-described antenna 10 having a plate width-to-plate spacing ratio of 3 for the wider tops of the plates and having a plate width-to-plate spacing ratio of 1.2 for the narrower trunks of the plates. When viewed at the half-power (−3 dB) points referenced by dashed line 104, the antenna 10 of the present invention achieves a four times improvement in instantaneous bandwidth. This greatly improves the versatility of the antenna for a given configuration.

It will be understood that many additional changes in the details, materials, steps and arrangement of parts, which have been herein described and illustrated in order to explain the nature of the invention, may be made by those skilled in the art within the principle and scope of the invention as expressed in the appended claims.

The foregoing description of the preferred embodiments of the invention has been presented for purposes of illustration and description only. It is not intended to be exhaustive nor to limit the invention to the precise form disclosed; and obviously many modifications and variations are possible in light of the above teaching. Such modifications and variations that may be apparent to a person skilled in the art are intended to be included within the scope of this invention as defined by the accompanying claims.

What is claimed is:

1. An antenna comprising:

a base;

a first support coupled to said base and extending perpendicular to said base;

a second support coupled to said base and extending perpendicular to said base, wherein said first support and said second support oppose one another and are spaced apart from one another; and a plurality of plates spaced apart and parallel to one another, each of said plates being T-shaped to have a trunk and a top wherein a width $W_1$ of said trunk is less than a width $W_2$ of said top, each said trunk coupled to one of said first support and said second support and extending perpendicular thereto wherein a corresponding said top is spaced from an opposing one of said first support and said second support by a distance S to thereby generate a gap region that serpentines between said first support and said second support and around said top of each of said plates;

wherein each of said base, said first support, said second support, and said plates are electrically conductive.

2. The antenna in accordance with claim 1, wherein said antenna is adapted to be fed at an interface between said trunk and said top associated with one of said plates nearest to said base.

3. The antenna in accordance with claim 1, wherein each of said plates is identically shaped and sized.

4. The antenna in accordance with claim 3, wherein a length $L_1$ of each of said plates extends from an outboard end of said trunk to an outboard end of said top, wherein length $L_1$ is measured perpendicular to width $W_2$, and wherein $L_1 \approx W_2 = \lambda/14$ where λ is a selected operating wavelength for said antenna.

5. The antenna in accordance with claim 4, wherein a length $L_2$ of each of said top is measured perpendicular to width $W_2$, and wherein $L_2 \approx W_1 = \lambda/25$.

6. The antenna in accordance with claim 5, wherein a length $L_3$ of each said trunk is measured perpendicular to width $W_1$, and wherein said length $L_3$ is equal to λ/36 with said antenna further comprising an antenna feed coupled to an interface between said trunk and said top associated with one of said plates nearest to said base.

7. The antenna in accordance with claim 1, wherein a spacing between adjacent ones of said plates is equal to distance S.

8. The antenna in accordance with claim 7, wherein distance S is equal to λ/42.

9. The antenna in accordance with claim 1, wherein a height H of said antenna is measured from said base to one of said plates furthest from said base, and wherein height H is equal to λ/12.

10. The antenna in accordance with claim 1, wherein each of said base, said first support, said second support, and said plates comprises solid metal.

11. The antenna in accordance with claim 1, wherein each of said base, said first support, said second support, and said plates comprises a metal-coated substrate.

12. The antenna in accordance with claim 1, wherein a width of each of said first support and said second support is equal to width $W_1$.

13. An antenna comprising:

a base;

a first support coupled to said base and extending perpendicular to said base;

a second support coupled to said base and extending perpendicular to said base, wherein said first support and said second support oppose one another and are spaced apart from one another; and a plurality of plates spaced apart and parallel to one another, each of said plates being identically sized and shaped, each of said plates being T-shaped to have a trunk and a top wherein a width $W_1$ of said trunk is less than a width $W_2$ of said top, each said trunk coupled to one of said first support and said second support and extending perpendicular thereto wherein a corresponding said top is spaced from an opposing one of said first support and said second support by a distance S to thereby generate a gap region that serpentines between said first support and said second support and around said top of each of said plates;

wherein each of said base, said first support, said second support, and said plates is electrically conductive, wherein said antenna is adapted to be fed at an interface between said trunk and said top associated with one of said plates nearest to said base.

14. The antenna in accordance with claim 13, wherein a length $L_1$ of each of said plates extends from an outboard end of said trunk to an outboard end of said top, wherein length $L_1$ is measured perpendicular to width $W_2$, and wherein $L_1 \approx W_2 = \lambda/14$ where $\lambda$ is a selected operating wavelength for said antenna.

15. The antenna in accordance with claim 14, wherein a length $L_2$ of each of said top is measured perpendicular to width $W_2$, and wherein $L_2 \approx W_1 = \lambda/25$.

16. The antenna in accordance with claim 15, wherein a length $L_3$ of each said trunk is measured perpendicular to width $W_1$, and wherein length $L_3$ is equal to $\lambda/36$, said antenna further comprising an antenna feed coupled to an interface between said trunk and said top associated with one of said plates nearest to said base.

17. The antenna in accordance with claim 13, wherein a spacing between adjacent ones of said plates is equal to distance S.

18. The antenna in accordance with claim 17, wherein distance S is equal to $\lambda/42$.

19. The antenna in accordance with claim 13, wherein a height H of said antenna is measured from said base to one of said plates furthest from said base, and wherein height H is equal to $\lambda/12$.

20. The antenna in accordance with claim 13, wherein each of said base, said first support, said second support, and said plates comprises solid metal.

21. The antenna in accordance with claim 13, wherein each of said base, said first support, said second support, and said plates comprises a metal-coated substrate.

22. The antenna in accordance with claim 13, wherein a width of each of said first support and said second support is equal to width $W_1$.

23. An antenna comprising:

a base;

a first support coupled to said base and extending perpendicular to said base;

a second support coupled to said base and extending perpendicular to said base, wherein said first support and said second support oppose one another and are spaced apart from one another;

a plurality of plates spaced apart and parallel to one another, each of said plates being identically sized and shaped, each of said plates being T-shaped to have a trunk and a top wherein a width $W_1$ of said trunk is less than a width $W_2$ of said top, each said trunk coupled to one of said first support and said second support and extending perpendicular thereto wherein a corresponding said top is spaced from an opposing one of said first support and said second support by a distance S to thereby generate a gap region that serpentines between said first support and said second support and around said top of each of said plates; and each of said base, said first support, said second support, and said plates being electrically conductive, wherein said antenna is adapted to be fed at an interface between said trunk and said top associated with one of said plates nearest to said base;

wherein a length $L_1$ of each of said plates extends from an outboard end of said trunk to an outboard end of said top, wherein length $L_1$ is measured perpendicular to width $W_2$, and wherein $L_1 \approx W_2 = \lambda/14$ where $\lambda$ is a selected operating wavelength for said antenna;

wherein a length $L_2$ of each of said top is measured perpendicular to width $W_2$, and wherein $L_2 \approx W_1 = \lambda/25$;

wherein a spacing between adjacent ones of said plates is equal to distance S and wherein distance S is equal to $\lambda/42$;

wherein a height H of said antenna is measured from said base to one of said plates that is furthest from said base, and wherein height H is equal to $\lambda/12$;

wherein a length $L_3$ of each said trunk is measured perpendicular to width $W_1$, and wherein length $L_3$ is equal to $\lambda/36$; and wherein a width of each of said first support and said second support is equal to width $W_1$.

24. The antenna in accordance with claim 23, wherein each of said base, said first support, said second support, and said plates comprises solid metal.

25. The antenna in accordance with claim 23, wherein each of said base, said first support, said second support, and said plates comprises a metal-coated substrate.

* * * * *